US006431840B1

(12) United States Patent
Mashimo et al.

(10) Patent No.: US 6,431,840 B1
(45) Date of Patent: Aug. 13, 2002

(54) MULTISTAGE HIGH PRESSURE COMPRESSOR

(75) Inventors: Denji Mashimo; Hiroshi Nishikawa; Takahiro Nishikawa; Yasuo Sakamoto; Takayuki Mizuno; Kazuya Sato; Makoto Aida, all of Osaka-fu (JP)

(73) Assignee: Sanyo Electric Co., Ltd., Osaka-fu (JP)

( * ) Notice: Subject to any disclaimer, the term of this patent is extended or adjusted under 35 U.S.C. 154(b) by 0 days.

(21) Appl. No.: 09/656,602

(22) Filed: Sep. 7, 2000

(30) Foreign Application Priority Data

Sep. 9, 1999 (JP) ..... 11-255784
Sep. 16, 1999 (JP) ..... 11-262195

(51) Int. Cl.[7] ..... F04B 25/00
(52) U.S. Cl. ..... 417/244
(58) Field of Search ..... 417/244, 245, 417/446, 447, 448, 449, 450, 451, 452, 453, 454, 455, 456, 457, 458, 459, 460, 461, 462, 463, 464, 465, 466, 467, 468

(56) References Cited

U.S. PATENT DOCUMENTS 4,095,922 A * 6/1978 Farr ..... 417/313
4,276,664 A * 7/1981 Baker ..... 4/491
4,369,633 A * 1/1983 Snyder ..... 62/117
4,373,865 A * 2/1983 Budzich ..... 417/46
4,788,944 A * 12/1988 Rascov ..... 123/47 R
4,960,039 A * 10/1990 Robertson ..... 92/165 R
5,266,015 A * 11/1993 Gannaway ..... 417/550
5,549,453 A * 8/1996 Murakami et al. ..... 417/269
6,144,128 A * 11/2000 Rosen ..... 310/74
6,152,014 A * 11/2000 Willimczik ..... 91/499
6,164,263 A * 12/2000 Saint-Hilaire et al. ..... 123/241
6,175,172 B1 * 1/2001 Bakholdin et al. ..... 310/74
6,305,911 B2 * 10/2001 Charron ..... 417/244

* cited by examiner

*Primary Examiner*—Teresa Walberg
*Assistant Examiner*—Daniel Robinson
(74) *Attorney, Agent, or Firm*—Weingarten, Schurgin, Gagnebin & Lebovici LLP

(57) ABSTRACT

There is provided a multistage high pressure compressor in which a rotor is supported with respect to a rotating shaft of an electric motor and which can suppress a torque fluctuation of the electric motor and achieve a stable operation of the electric motor. A fly wheel is attached to a lower end of the rotating shaft of the electric motor, and the fly wheel supports the rotor of the electric motor with respect to the rotating shaft. The fly wheel is connected to the lower end of the rotating shaft of the electric motor by a bolt, and an extension of a detent key between the rotating shaft of the electric motor and the rotor of the electric motor is inserted into the fly wheel. Moreover, there is provided a multistage high pressure compressor achieving improved sealing between a cylinder and members surrounding the periphery thereof, which is capable of realizing a simplified processing of the cylinder and an easy assembly process. Seal spaces in which seal rings are compressed between the cylinder and the members surrounding thereof are provided at the outer peripheries at the both ends of the cylinder.

6 Claims, 10 Drawing Sheets

MULTISTAGE HIGH PRESSURE COMPRESSOR

BACKGROUND OF THE INVENTION

1. Field of the Invention

The present invention relates to a multistage high-pressure compressor having a multistage compression mechanism section which compresses an intake working fluid so as to generate a high pressure working fluid. More particularly, the present invention relates to a torque fluctuation suppressing device in an electric motor of the multistage high pressure compressor. The present invention also relates to a sealing device of a multistage high-pressure compressor, and more particularly to a seal structure between a cylinder and a member surrounding the outer periphery thereof.

2. Detailed Description of the Prior Art

A multistage high-pressure compressor including an electric motor provided in a lower part thereof and a compression mechanism section provided in an upper part thereof has been known. In such a multistage high-pressure compressor, the compression mechanism section has a plurality of compression sections, and reciprocates a piston with respect to a cylinder by the rotation of a rotating shaft which extends upwardly from the electric motor. The reciprocation of the piston causes an intake working fluid to be compressed through a plurality of compression stages, thereby generating a high-pressure working fluid. Examples of this type of multistage high-pressure compressor include a multistage compression device which is one of high-pressure gas compressors invented by the present applicant prior to the filing date of the present application. Such a multistage compression device is described in Japanese Patent Application Nos. 11-81781 and 11-46748, for example.

FIG. 1 illustrates a prior art showing a relationship between a compression mechanism section and an electric motor. In FIG. 1, reference numeral 20 denotes an electric motor. The electric motor 20 includes a stator 22 which has a coil 21 and is fixed to an inner surface of a motor casing 24, and a rotor 25 which is provided inside the stator 22 and spaced from the stator 22 by a predetermined air gap. A rotating shaft 23 of the rotor 25 extends upwardly. A compression mechanism section 26 is provided above the electric motor 20. Reference numerals 27 and 28 denote housing members attached to the upper and lower sides of the motor casing 24. The motor casing 24 and the housing members 27 and 28 together contain the electric motor 20. Reference numerals 29 and 30 denote bearings for rotatably supporting the rotating shaft 23. Reference numeral is a detent key for preventing the rotor 25 from rotating with respect to the rotating shaft 23.

In the above-described structure, a piston 32 is reciprocated with respect to a cylinder 31 of the compression mechanism section 26 by the rotation of the rotating shaft 23. The reciprocation of the piston 32 causes a working fluid such as an intake gas to be compressed through four stages, thereby generating a high-pressure gas. The structure and operation of a high-pressure compressor of such a four-stage compression mechanism are described in the aforementioned Japanese Patent Application Nos. 11-81781 and 11-46748.

As illustrated in FIG. 1, the electric motor 20 includes the rotor 25, in which a circular plate 33 for receiving the lower surface of the rotor 25 is fixed to the lower end of the rotating shaft 23 by a bolt 34 which is screwed into the rotating shaft 23, thereby supporting the rotor 25 with respect to the rotating shaft 23.

The detent key 35 which is disposed between the rotating shaft 23 and the rotor 25 is for preventing the rotor 25 from rotating with respect to the rotating shaft 23. The whole detent key 35 is included in the rotor 25.

As described above, the prior art requires the circular plate 33 which is provided for supporting the rotor 25 with respect to the rotating shaft 23 of the electric motor 20. Thus, a torque fluctuation of the electric motor 20 occurs in the prior art case, and neither structures nor effects for suppressing such a torque fluctuation are provided in the prior art.

The second problem to be solved by the present invention will now be described in connection with a prior art multistage high-pressure compressor shown in FIG. 2 to FIG. 5. A multistage high-pressure compressor 100 includes four compression sections (compression stage sections) 101, 102, 103, and 104, i.e., the compressor is the four-stage compressor. The compression sections 101 and 103 are disposed on a horizontal axis 106, and the compression sections 102 and 104 are disposed on a horizontal axis 105. A reciprocal compression mechanism is composed of cylinders 71, 72, 73, and 74 which are fixed members, and pistons 51, 52, 53, and 54 which are movable members reciprocating therein, arranged on the axes 106 and 105.

First, a working fluid taken in from an intake tube 118 is compressed at the first stage compression section 101. Next, the working fluid compressed at the first stage compression section 101 enters the second stage compression section 102 via a conduit 5 to be compressed. Then, the working fluid compressed at the second stage compression section 102 enters the third stage compression section 103 via a conduit 6 to be compressed. Thereafter, the working fluid compressed at the third stage compression section 103 enters the fourth stage compression section 104 via a conduit 7 to be compressed. The thus-obtained high-pressure working fluid with predetermined pressure and flow rate is output from a discharge tube 8.

The working fluid in such a multistage high-pressure compressor 100 is a gas such as nitrogen, a natural gas, sulfur hexafluoride ($SF_6$), and an air. The multistage compressor 100 can be applied to a natural gas filling machine for filling a natural gas into a Bombe (cylinder) of an automobile using a natural gas, a high pressure nitrogen gas supply to a gas injection molding machine which uses a high pressure nitrogen gas during injection molding of synthetic resin, filling machine for filling a high pressure air into an air Bombe, or the like.

In the multistage high-pressure compressor 100, the piston 51 in the first stage compression section 101 and the piston 53 in the third stage compression section 103 are connected to a yoke 1A on the axis 106. A cross slider 2A which is movably provided so as to cross the axis 106 in the yoke 1A is connected to a crankshaft 4 via a crank pin 3. The axes 105 and 106 cross at an angle of 90 degrees as viewed from the above. The piston 52 in the second stage compression section 102 and the piston 54 in the fourth stage compression section 104 are connected to a yoke 1B on the axis 105. A cross slider 2B which is movably provided so as to cross the axis 105 in the yoke 1B is connected to the crankshaft 4 via the crank pin 3.

The crankshaft 4 is rotated by the electric motor 20 (see, e.g., FIG. 1) which is provided below the compression sections 101 to 104. The rotation of the crankshaft 4 causes the crank pin 3 which is provided eccentrically with respect to the crankshaft 4 to be rotated around the crankshaft 4.

Regarding the yoke 1A, a displacement of the crank pin 3 in the direction of the axis 105 is accommodated by the movement of the cross slider 2A, and a displacement of the crank pin 3 in the direction of the axis 106 is accommodated by the movement of the yoke 1A. Accordingly, the pistons 51 and 53 reciprocate only in the direction of the axis 106.

On the other hand, regarding the yoke 1B, a displacement of the crank pin 3 in the direction of the axis 106 is accommodated by the movement of the cross slider 2B, and a displacement of the crank pin 3 in the direction of the axis 105 is accommodated by the movement of the yoke 1B. Accordingly, the pistons 52 and 54 reciprocate only in the direction of the axis 105.

FIG. 5 is a cross-sectional view showing the structure of the first stage compression section 101 of the multistage high-pressure compressor 100. The first stage compression section 101 includes a first compression chamber 58 and a second compression chamber 59 provided on opposite sides of the piston 51.

When the piston 51 advances, a working fluid is taken into the first compression chamber 58 in directions indicated by arrows via opened valves e and f, with valves a and b being closed. A working fluid in the second compression chamber 59 is simultaneously compressed. When the compressed working fluid in the second compression chamber 59 reaches a predetermined pressure, the working fluid is discharged to the outside via opened valves c and d. Thereafter, the working fluid is sent to the second stage compression section 102 via the conduit 5 as illustrated in an arrow shown in FIG. 3 and FIG. 5.

When the piston 51 retracts, the valves e and f are closed, and the working fluid in the first compression chamber 58 is compressed. When the compressed working fluid reaches a predetermined pressure, the valves a and b are opened, thus discharging the working fluid to the second compression chamber 59. Reference numeral 60 denotes a rod guide for guiding a connecting rod 57 so that the connecting rod 57 smoothly reciprocates between predetermined positions without vibrations.

As described above, the first stage compression section 101 of the multistage high-pressure compressor 100 employs a double compression mechanism (double action mechanism) such that a working fluid is taken in, compressed, and discharged through two steps in the single cylinder 71. Each of the second stage compression section 102, the third stage compression section 103, and the fourth stage compression section 104 employs, instead of the double compression mechanism as that of the first stage compression section 101, an ordinary arrangement, so-called a "single action mechanism," where the intake gas is compressed through a single stage compression in the cylinder by reciprocating the piston with respect to the cylinder.

In the above-described structure, the pressure of a gas which is the working fluid taken in from the intake tube 118 is generally about 0.05 MPa(G), and the gas is compressed to about 0.5 MPa(G) in the first stage compression section 101. The compressed gas is supplied to the second stage compression section 102 through the conduit 5. Then, the gas is compressed to about 2 MPa(G) in the second stage compression section 102. Thereafter, the compressed gas is supplied to the third stage compression section 103 through the conduit 6. The gas is compressed to about 7 to 10 MPa(G) in the third stage compression section 103. Thereafter, the compressed gas is supplied to the fourth stage compression section 104 through the conduit 7. The gas is compressed to about 20 to 30 MPa(G) in the fourth stage compression section 104. The thus-obtained high pressure gas (high pressure working fluid) is supplied from the discharge tube 8 to an accumulator. The high-pressure gas is supplied from the accumulator into an article of interest, e.g., a gas injection molding machine, an air Bombe, or the like.

In the above-described prior art, the respective cylinders 71, 72, 73, and 74 of the first stage compression section 101 through the fourth stage compression section 104 are supported within a housing 70 and respective cylinder heads 75, 76, 77, and 78 bolted thereto. Depending on the particular compression mechanism structure, a valve seat having an intake valve or a- discharge valve for the piston is provided in the first stage compression section 101 through the fourth stage compression section 104.

With reference to FIG. 6, sealing state of the cylinder 71 in the first stage compression section 101 will now be discussed. Two seal grooves 80 are provided on the outer peripheral surface of the cylinder 71. Seal rings (O rings) 81 are respectively disposed in the two seal grooves 80. The sealing between the members surrounding the cylinder 71 (in this case, the housing 70 and the cylinder head 75) and the cylinder 71 is provided by the seal rings (O rings) 81 being compressed between the cylinder 71 and the housing 70 and between the cylinder 71 and the cylinder head 75. Reference numeral 82 denotes a piston ring provided in the piston 51.

In order to reinforce the sealing in the above-described prior art, strong compression of the seal rings (O rings) 81 is required. However, the assembly of the seal rings (O rings) 81 with the cylinder 71, the housing 70, and the cylinder head 75 becomes more difficult. In order to achieve a suitable sealing state, the depth and width of each of the seal grooves 80 with respect to each of the seal rings (O rings) 81 become more critical. Therefore, high accuracy is required for the processing of the seal grooves 80 to be provided along the periphery of the cylinder in connection with the dimension of the seal rings (O rings) 81. Thus, a seal mechanism which realizes a simplified processing of the cylinder and an easy assembly process is required.

SUMMARY OF THE INVENTION

In view of the problems as described above, an object of the present invention is to provide a multistage high pressure compressor which has a device capable of supporting a rotor with respect to a rotating shaft of an electric motor and suppressing a torque fluctuation of the electric motor. Moreover, another object of the present invention is to provide a multistage high-pressure compressor in which a stable operation of the electric motor can be obtained.

In order to achieve the above-described objects, the present invention employs technical means such that a rotor of an electric motor is supported with respect to a rotating shaft by a fly wheel attached to a lower end of the rotating shaft of the electric motor.

The present invention also employs technical means such that the fly wheel is connected to the lower end of the rotating shaft of the electric motor by a bolt, and an extension of a detent key between the rotating shaft of the electric motor and the rotor of the electric motor is inserted into the fly wheel.

The present invention also employs technical means such that the lower end of the rotating shaft of the electric motor and the fly wheel to be attached thereto are thread-coupled by screws mating with each other, which are formed in the lower end of the rotating shaft of the electric motor and the fly wheel.

The present invention also employs technical means such that the lower end of the rotating shaft of the electric motor and the fly wheel to be attached thereto are joined by shrink-fitting therebetween.

According to the present invention, the circular plate used to support the rotor in the prior art can be eliminated, and the fly wheel is provided instead, which plays the role of supporting the rotor and can also ensure a smooth rotation of the rotor. Therefore, the vibration of the multistage compression device can be reduced. Moreover, the temperature of the coil of the electric motor used in the multistage compression device can be decreased, thereby improving the reliability of the multistage compression device.

In addition to the above-described effects, since the extension of the detent key is inserted into the fly wheel, there is provided a sufficient effect of preventing the fly wheel from rotating with respect to the rotating shaft without having to screwing the fly wheel with a bulky bolt. Both the rotor and the fly wheel can be stopped from rotating by using a common key, thereby reducing the number of components and the number of assembly steps.

Furthermore, the fly wheel is attached to the rotating shaft by joining screws formed in the fly wheel and the rotating shaft. Therefore, in addition to the above-described effects, the bolt for fixing the fly wheel with respect to the rotating shaft is no longer necessary, thereby reducing the number of components and facilitating the fixing of the fly wheel.

Also, the fly wheel is attached to the rotating shaft by shrink-fitting. Therefore, in addition to the effects of the first invention, the bolt for fixing the fly wheel with respect to the rotating shaft is no longer necessary, thereby reducing the number of components and achieving the firm fixing of the fly wheel.

Moreover, in view of the problems as described above, an object of the present invention is to provide a multistage high pressure compressor including a seal mechanism which can provide a sufficient sealing effect and can achieve a simplified processing of the cylinder and an easy assembly process. Therefore, as the particular means for solving the above-described problems, the present invention employs technical means such that seal spaces in which seal rings are respectively compressed between the cylinder and members surrounding thereof are provided at the outer peripheries at both ends of the cylinder in a multistage high pressure compressor having a compression mechanism section which generates a high pressure working fluid by reciprocating a piston utilizing the rotation of an electric motor with respect to the cylinder, and compressing the intake working fluid through a plurality of compression stages utilizing the reciprocation of the piston.

According to the present invention, since the seal spaces in which the seal rings are respectively compressed between the cylinder and the members surrounding thereof are provided at the outer peripheries at both ends of the cylinder, the processing of the cylinder is facilitated as compared to that of a cylinder such that a seal groove is formed along the mid portion of the outer periphery thereof. Also, in the assembly, it is no longer necessary to perform the cumbersome process as in the prior art of moving the seal ring from one end of the cylinder to the seal groove provided in the outer peripheral surface of the cylinder and fitting the seal ring along the seal groove.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

The present invention will now be specifically described with reference to the accompanying drawings. Since the operation of a multistage high pressure compression mechanism section is the same as that described above, the description thereof will be omitted herein (see the aforementioned description provided with reference to FIG. 2 to FIG. 5).

Figure 1:
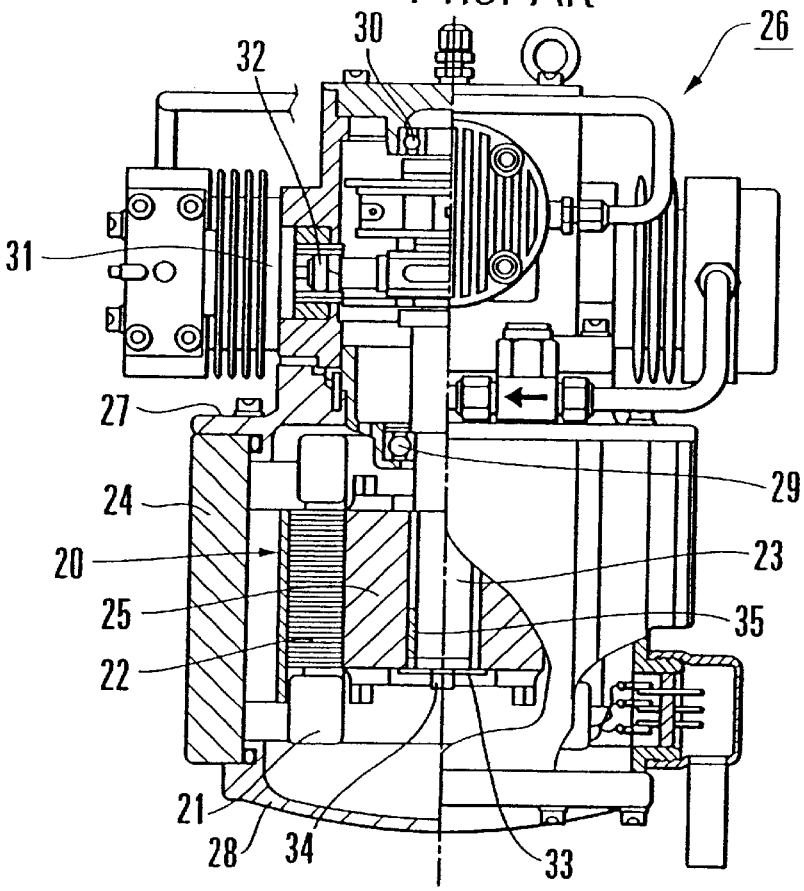
FIG. 1 Prior Art
FIG. 1 is a side view of a multistage high pressure compressor according to a prior art, illustrated partially in cross section.
Figure 2:
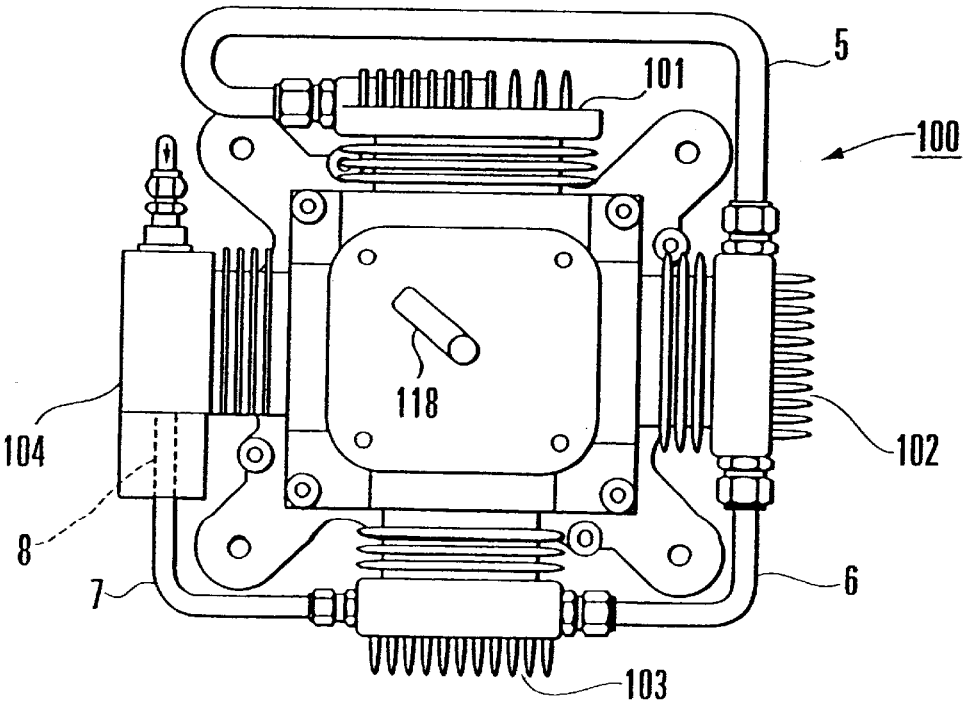
FIG. 2 Prior Art
FIG. 2 is a plan view of a multistage high pressure compressor to which the present invention is pertinent.
Figure 7:
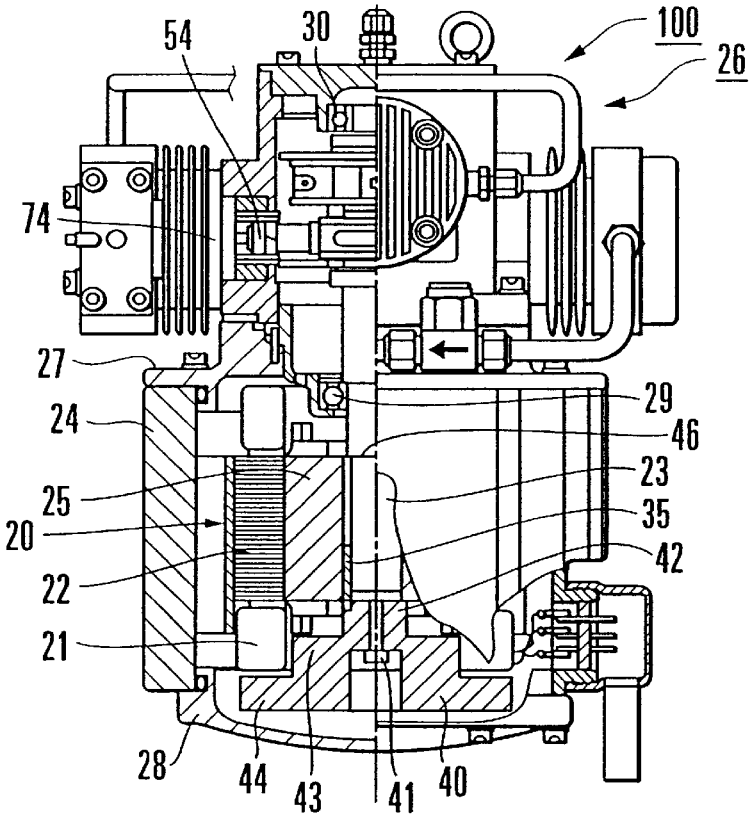
FIG. 7 is a side view of a multistage high pressure compressor according to the first embodiment of the first invention, illustrated partially in cross section.

FIG. 7 illustrates the first embodiment of the first invention. In FIG. 7, the same components as those in FIG. 1 are denoted by the same reference numerals as those in FIG. 1. In FIG. 7, reference numeral 40 denotes a fly wheel which is fixed to the lower end of the rotating shaft 23 by a bolt 41. The fly wheel 40 is provided to cover the lower surfaces of the rotor 25 and the coil 21, and includes a portion 42 corresponding to the rotating shaft 23, a portion 43 corresponding to the rotor 25, and a portion 44 corresponding to the coil 21. The fly wheel 40 is formed in a stepped configuration whose diameter increases downwardly. The rotor 25 is supported by the portion 42 corresponding to the rotating shaft 23. The upward movement of the rotor 25 is regulated by a step portion 46 which is formed in the rotating shaft 23. The rotor 25 abuts the step portion 46 if it moves upwardly, so that the upward movement of the rotor 25 is regulated.

The detent key 35 is provided between the rotating shaft 23 and the rotor 25, thereby preventing the rotor 25 from rotating with respect to the rotating shaft 23. The whole detent key 35 is included in the rotor 25.

By the thus-structured multistage high pressure compressor of the present invention, the circular plate 33 used to support the rotor 25 in the prior art can be eliminated, and the fly wheel 40 is provided instead, which plays the role of supporting the rotor 25 and can also ensure a smooth rotation of the rotor 25. Thus, the vibration of the multistage high pressure compressor 100 can be reduced. The output of the electric motor 20 used in the multistage high pressure compressor 100 is about 2.0 kw, for example, and the current value of the electric motor 20 when it is overloaded can be reduced from about 11 A (amperes) to about 7 A (amperes). Therefore, the temperature of the coil 21 of the electric motor 20 can be decreased from about 110° C. to about 80° C., thereby improving the reliability of the multistage high pressure compressor 100.

Figure 8:
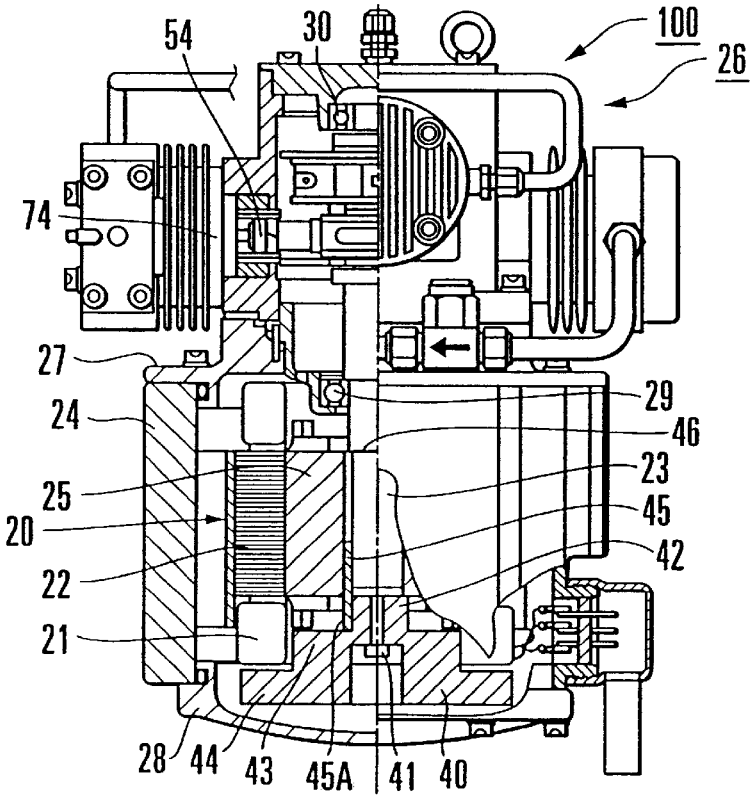
FIG. 8 is a side view of a multistage high pressure compressor according to the second embodiment of the first invention, illustrated partially in cross section.

FIG. 8 illustrates the second embodiment of the first invention. In FIG. 8, the same components as those in FIG. 7 are denoted by the same reference numerals as those in FIG. 7. The rotor 25 is supported by the portion 42 corresponding to the rotating shaft 23. The second embodiment is different from the first embodiment in that a downward extension 45A of a detent key 45 is inserted into a groove formed in the side surface of the portion 42 of the fly wheel 40.

Accordingly, there is provided a sufficient effect of preventing the fly wheel from rotating with respect to the rotating shaft without having to screw the fly wheel with the bulky bolt 41. Both the rotor and the fly wheel can be stopped from rotating by using a common key, thereby reducing the number of components and the number of assembly steps. Moreover, as in the above-described first embodiment, the circular plate 33 used to support the rotor 25 in the prior art can be eliminated, and the fly wheel 40 is provided instead, which plays the role of supporting the rotor 25 and can also ensure a smooth rotation of the rotor 25.

Figure 9:
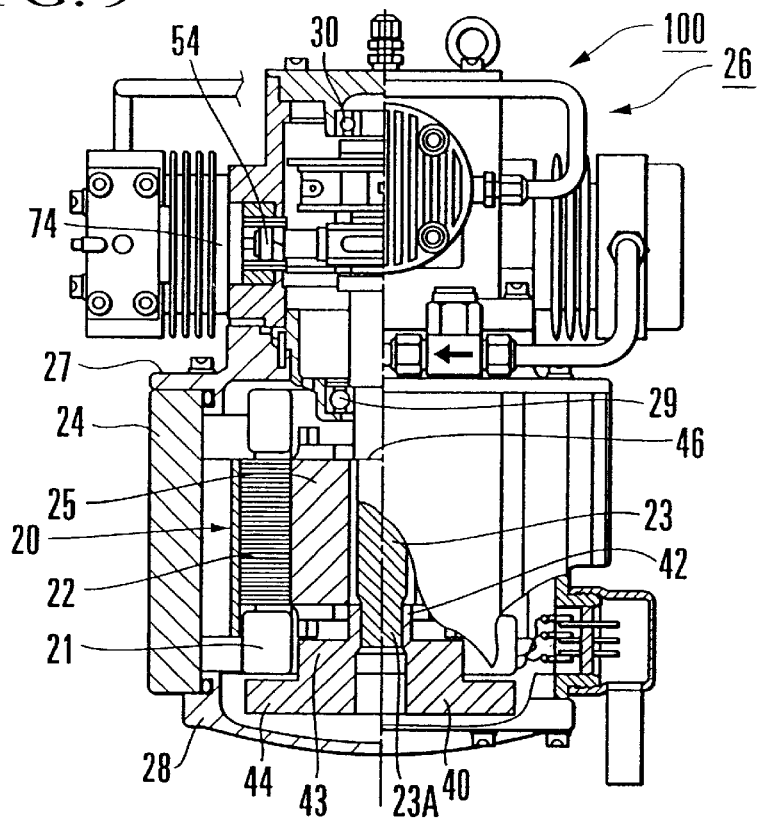
FIG. 9 is a side view of a multistage high pressure compressor according to the third embodiment of the first invention, illustrated partially in cross section.

FIG. 9 illustrates the third embodiment of the first invention. In FIG. 9, the same components as those in FIG. 7 are denoted by the same reference numerals as those in FIG. 7. The rotor 25 is supported by the portion 42 corresponding to the rotating shaft 23. According to the third embodiment of the first invention, the fly wheel 40 is fixed to the lower end of the rotating shaft 23 by thread-coupling between a male screw formed in a lower end portion 23A of the rotating shaft 23 and a female screw formed in the portion 42 of the fly wheel 40.

Figure 10:
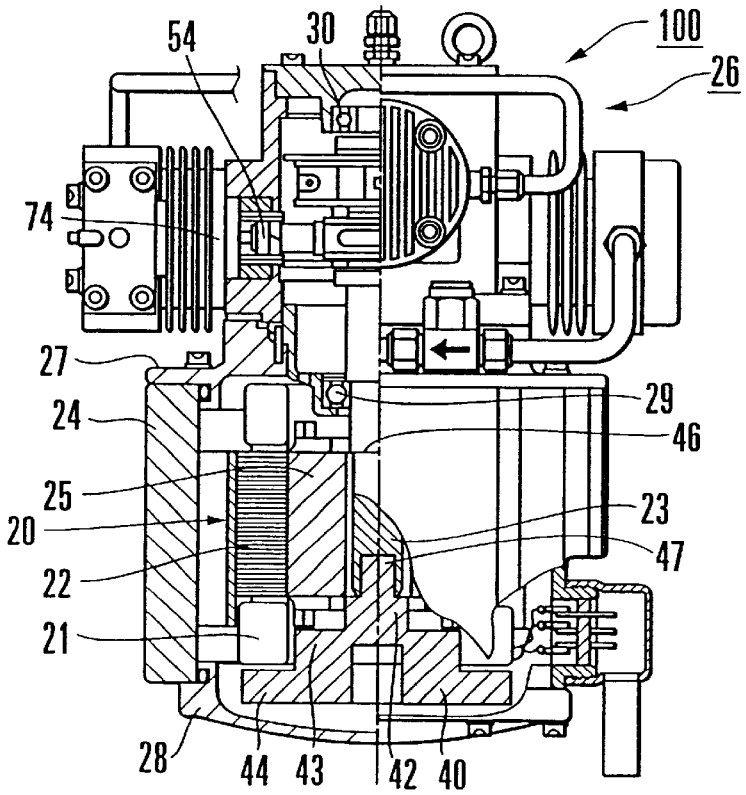
FIG. 10 is a side view of a multistage high pressure compressor according to a variation of the third embodiment of the first invention, illustrated partially in cross section.

FIG. 10 illustrates a variation of the third embodiment of the first invention. In FIG. 10, the same components as those in FIG. 9 are denoted by the same reference numerals as those in FIG. 9, and the description thereof is the same as that in the case of FIG. 9. The rotor 25 is supported by the portion 42 corresponding to the rotating shaft 23. The variation of the third embodiment is different from the aforementioned embodiment in a method for fixing the fly wheel 40 to the lower end portion of the rotating shaft 23. More specifically, the fly wheel 40 is fixed to the lower end of the rotating shaft 23 by thread-coupling between a female screw formed in the lower end portion of the rotating shaft 23 and a male screw protruding from the portion 42 of the fly wheel 40.

Thus, in the third embodiment, the bolt for fixing the fly wheel 40 with respect to the rotating shaft 23, which is used in the above-described first and second embodiments, is no longer necessary, thereby reducing the number of components and facilitating the fixing of the fly wheel 40. Moreover, as in the above-described first embodiment, the circular plate 33 used to support the rotor 25 in the prior art can be eliminated, and the fly wheel 40 is provided instead, which plays the role of supporting the rotor 25 and can also ensure a smooth rotation of the rotor 25.

Figure 11:
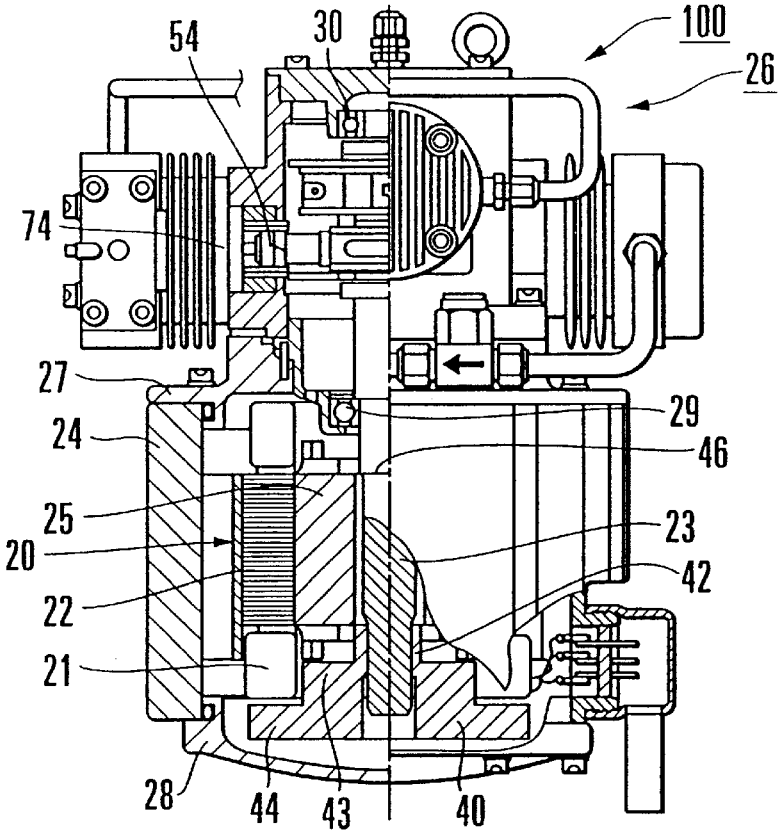
FIG. 11 is a side view of a multistage high pressure compressor according to the fourth embodiment of the first invention, illustrated partially in cross section.

FIG. 11 illustrates the fourth embodiment of the first invention. In FIG. 11, the same components as those in FIG. 9 and FIG. 10 are denoted by the same reference numerals as those in FIG. 9 and FIG. 10, and the description thereof is the same as that in the case of FIG. 9. The rotor 25 is supported by the portion 42 corresponding to the rotating shaft 23. The fourth embodiment of the first invention is different from the aforementioned embodiments in a method for fixing the fly wheel 40 to the lower end portion of the rotating shaft 23. More specifically, the fly wheel 40 is fixed to the lower end portion of the rotating shaft 23 by shrink-fitting the lower end portion of the rotating shaft 23 into a hole which is formed in the portion 42 of the fly wheel 40.

Thus, in the fourth embodiment, the bolt for fixing the fly wheel 40 with respect to the rotating shaft 23, which is used in the above-described first and second embodiments, is no longer necessary, thereby reducing the number of components and achieving the firm fixing of the fly wheel 40. Moreover, as in the above-described first invention, the circular plate 33 used to support the rotor 25 in the prior art can be eliminated, and the fly wheel 40 is provided instead, which plays the role of supporting the rotor 25 and can also ensure a smooth rotation of the rotor 25.

An embodiment of the second invention will now be described. The present invention relates to an improvement of a seal structure between a cylinder and members surrounding thereof in the multistage high pressure compressor 100 of the above-described prior art. Upon describing embodiments of the present invention, the same components as those in the multistage high pressure compressor 100 of the above-described prior art are denoted by the same reference numerals as those used in the multistage high pressure compressor 100 of the above-described prior art. Components different from those used in the multistage high pressure compressor 100 of the above-described prior art are denoted by reference numerals different from those used in the multistage high pressure compressor 100 of the above-described prior art, and the description thereof will be provided.

Figure 6:
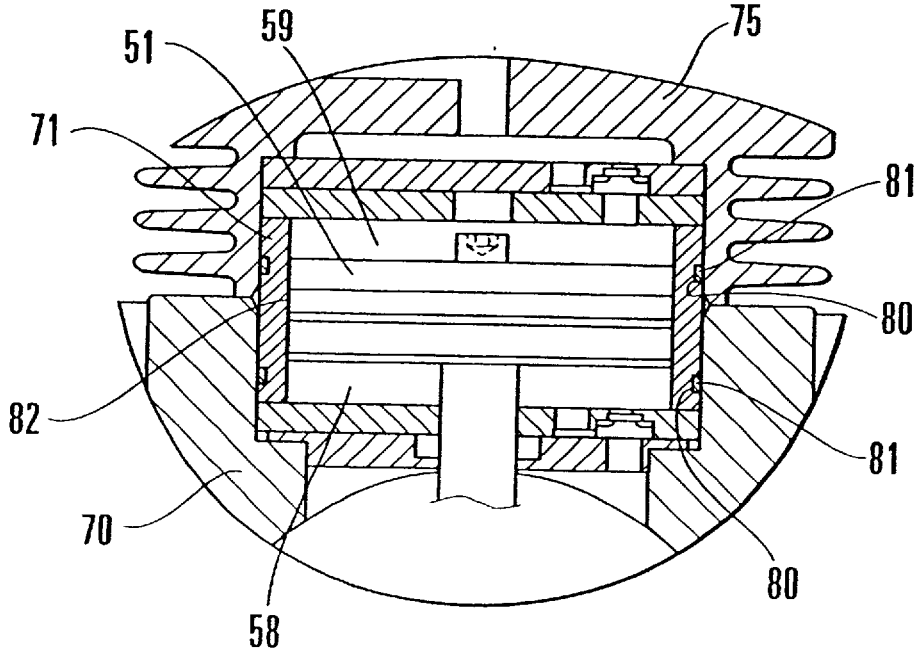
FIG. 6 Prior Art
FIG. 6 is a cross-sectional view showing a seal structure according to the prior art.
Figure 12:
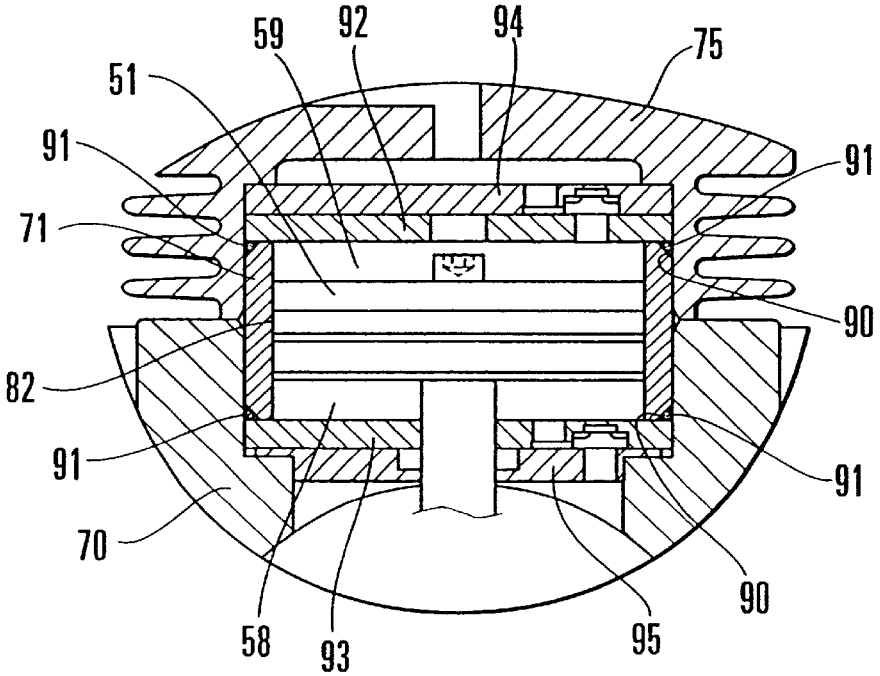
FIG. 12 is a cross-sectional view showing a seal structure according to the second invention.
Figure 13:
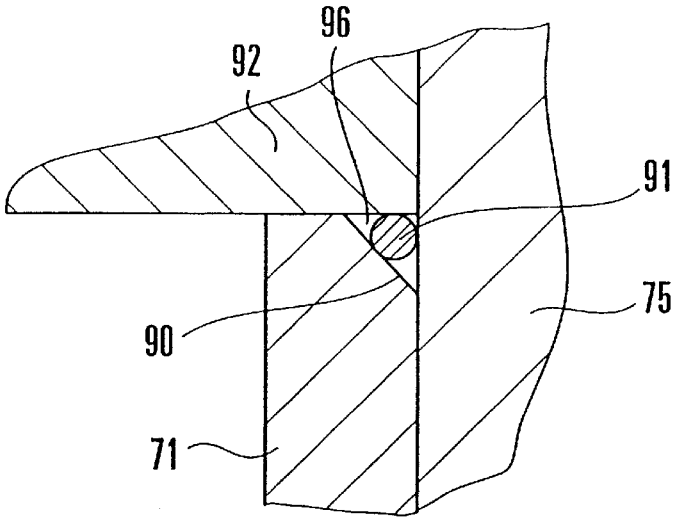
FIG. 13 is an enlarged cross-sectional view showing the seal structure according to the second invention.

In the second invention, seal spaces in which seal rings are compressed between the cylinder and members surrounding thereof are provided at the outer peripheries at the both ends of the cylinder. As one example of such an embodiment, the structure of the first stage compression section 101 of the multistage high pressure compressor 100 is shown in FIGS. 12 and 13. FIGS. 12 and 13 are different from FIG. 6 as to portions where seal rings (O rings) 91 are disposed.

First valve seats 92 and 93 and second valve seats 94 and 95 are respectively provided on both end surfaces of the cylinder 71 in the axial direction. Cut surfaces 90 (so-called C (cut) chamfering), each of which forms an angle of generally 45 degrees with respect to the axial direction of the cylinder 71, are provided at the outer peripheries at the both ends of the cylinder 71. Accordingly, seal spaces 96 which are annular grooves with generally triangular cross sections are formed between the cylinder 71 and the first valve seat 92 and the cylinder head 75 which are members surrounding the cylinder 71, and between the cylinder 71 and the first valve seat 93 and the housing 70 which are members surrounding the cylinder 71. FIG. 13 is an enlarged diagram showing the important part.

Sealing between the cylinder 71 and the members surrounding thereof is provided by the seal rings (O rings) 91 being compressed in the seal spaces 96 by the assembly of the cylinder 71, the housing 70, the cylinder head 75, the first valve seats 92 and 93, the second valve seats 94 and 95, and the like.

In the assembly, the seal rings (O rings) 91 are disposed at the outer peripheries at the both ends of the cylinder 71. Therefore, it is no longer necessary to perform the cumbersome process as in the prior art of moving the seal ring (O ring) from one end of the cylinder 71 to the seal groove provided in the outer peripheral surface of the cylinder 71 and fitting the seal ring along the seal groove. Moreover, the seal spaces 96 can be readily formed at the outer peripheries at the both ends of the cylinder 71 by performing the same processing as that of chamfering.

Within the seal space 96, there exists an acute-angled space of relief around the seal ring (O ring) 91. In the case where the diameter of the seal ring (O ring) 91 is considerably greater than that of the cylinder, even when the seal ring 91 is compressed by the cylinder head 75, the housing 70, and the like under the assembled state, the force acting thereon is weakened by the inclined cut surface. Therefore, the easy assembly is achieved. Thus, in the processing of the seal spaces 96, high accuracy thereof with respect to the dimension of the seal ring (O ring) 91, which is required in the prior art, is no longer necessary, thereby realizing the easy processing.

Although the above-described embodiment concerns the first stage compression section 101, the present invention is not limited thereto. Depending on the structure of a compression mechanism, the aforementioned embodiment can be applied to a compression section of a different stage, and various structures can be made. Therefore, in the compression mechanism section of the multistage high pressure compressor 100, the effects of the present invention can be obtained as long as the seal spaces in which the seal rings are compressed between the cylinder and the members surrounding thereof are provided at the outer peripheries at the both ends of the cylinder.

Although the seal spaces are formed by the cut surfaces (so-called C-chamfering) 90 cut in an angle of generally 45 degrees with respect to the axial direction of the cylinder 71 at the outer peripheries at the both ends of the cylinder 71, a curved surface or any other shape can be used instead of C-chamfering. Various changes can be made as long as the gist of the present invention is not changed.

Figure 14:
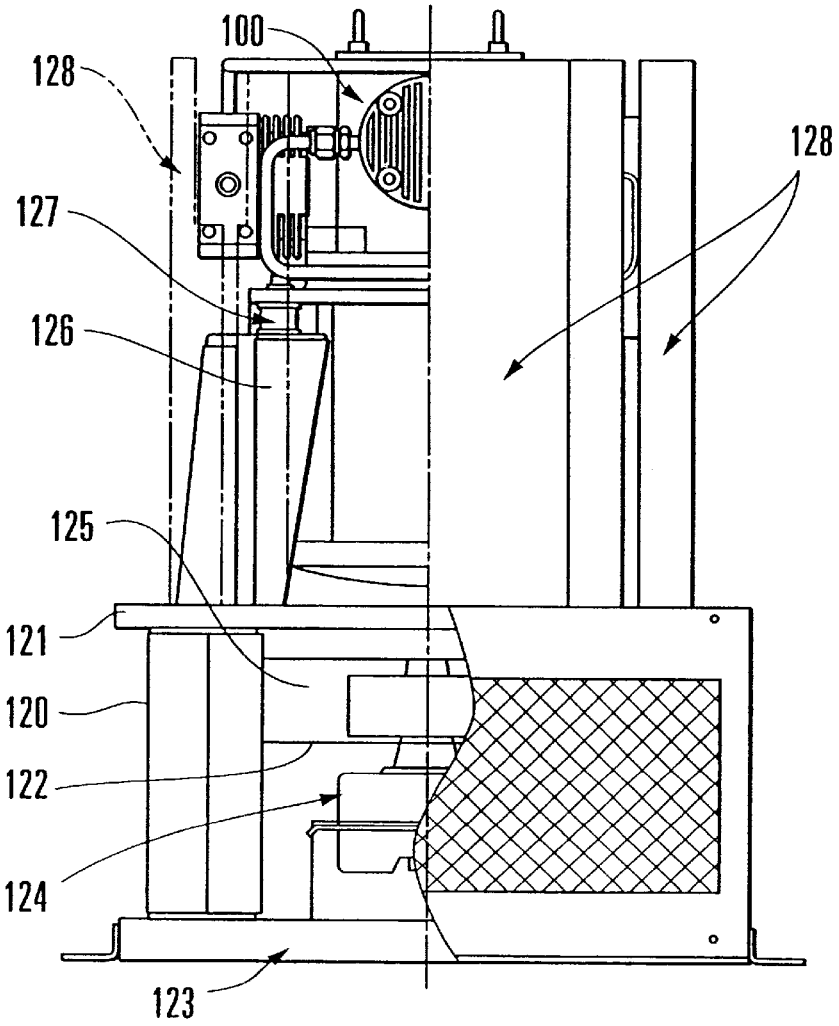
FIG. 14 is a side view showing that a multistage high pressure compressor according to the present invention is placed on a seat, illustrated partially in cross section.

FIG. 14 illustrates the structure such that the multistage high pressure compressor 100 according to the present invention is placed on a bed 120. The bed 120 generally comprises two sections. One is a first base section 121 for placing the multistage high pressure compressor 100 according to the present invention in the upper stage, and the other is a second base section 123 positioned below the multistage high pressure compressor 100, for placing a blower 122 for blowing a cooling air to the multistage high pressure compressor 100 from below. The blower 122 has an electric motor 124 which is fixed to the second base section 123 and a blade 125 which is rotated by the electric motor 124. The high pressure compressor 100 is supported by four legs 126 extending from the first base section 121 via a vibration proof rubber 127 at the upper end of each leg 126.

In order to promote heat radiation of the multistage high pressure compressor 100, the bed 120 has a plurality of duct plates 128 which are attached to the first base section 121 so as to surround the multistage high pressure compressor 100. The duct plates 128 are removably attached to the first base section 121 or a pole secured to the first base section 121 by a screw for the purpose of repairing and inspection of the multistage high pressure compressor 100. Accordingly, heat radiation of the multistage high pressure compressor 100 is facilitated by the duct plates 128. By removing the duct plates 128, the repairing and inspection of the multistage high pressure compressor 100 can be readily performed.

Figure 3:
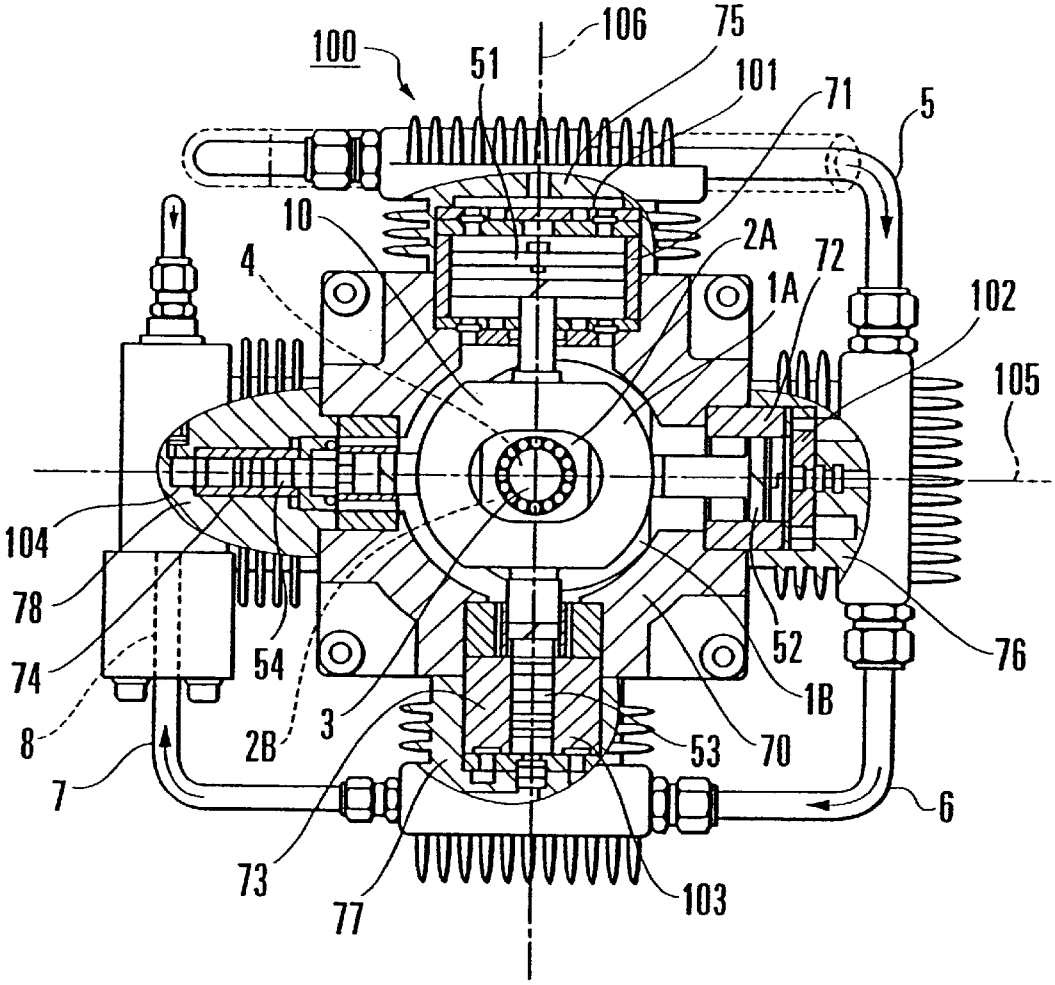
FIG. 3 Prior Art
FIG. 3 is a plan view of the multistage high pressure compressor to which the present invention is pertinent, showing each compression section in cross section.
Figure 4:
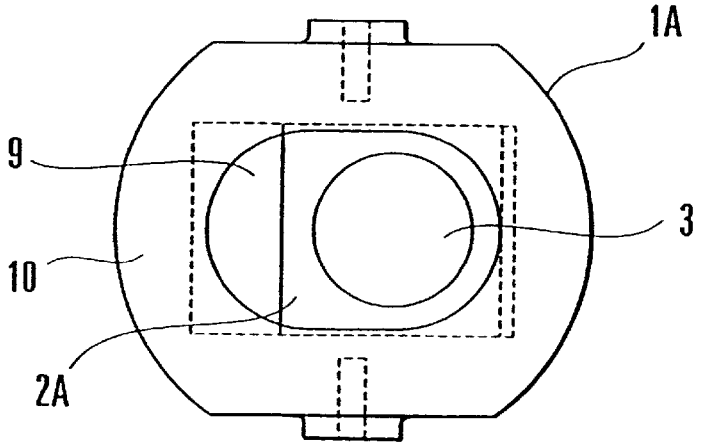
FIG. 4 Prior Art
FIG. 4 is a plan view showing a yoke and cross slider section in the multistage high pressure compressor to which the present invention is pertinent.
Figure 5:
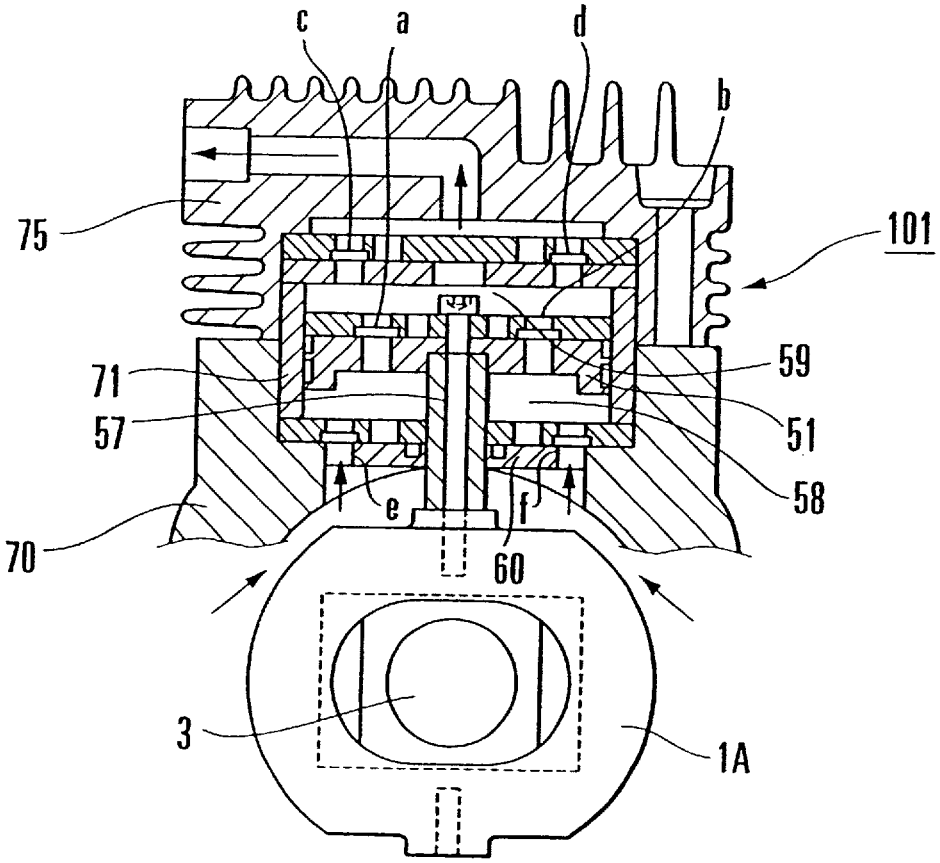
FIG. 5 Prior Art
FIG. 5 is a cross-sectional view of a first stage compression section of the multistage high pressure compressor to which the present invention is pertinent.
Figure 15:
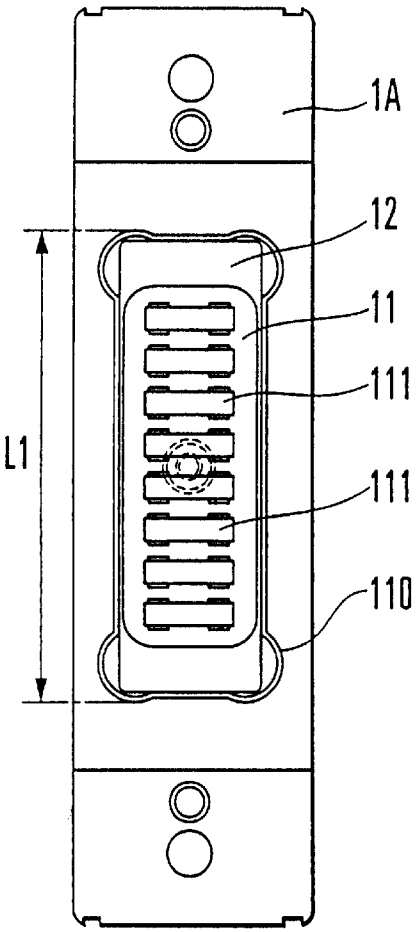
FIG. 15 Prior Art
FIG. 15 is a diagram showing the structure of a slide mechanism portion of a cross slider in a multistage high pressure compressor according to the prior art.

FIG. 15 shows a slide mechanism portion of the cross slider 2A in the multistage high pressure compressor 100 according to the prior art. This mechanism is shown in FIG. 3 of the aforementioned Japanese Patent Application No. 11-81781. FIG. 15 is a diagram showing the slide mechanism portion of the cross slider 2A of the prior art as viewed from the side of a rolling bearing 11. A liner plate 12 has a uniform thickness and the shape of a flat plate. The liner plate 12 is set in a receptacle (shoe) 110 for the liner plate 12, and the receptacle 110 is formed in the yoke 1A. The rolling bearing 11 having a plurality of rollers 111 arranged in the length direction is disposed on the surface of the liner plate 12.

Figure 16:
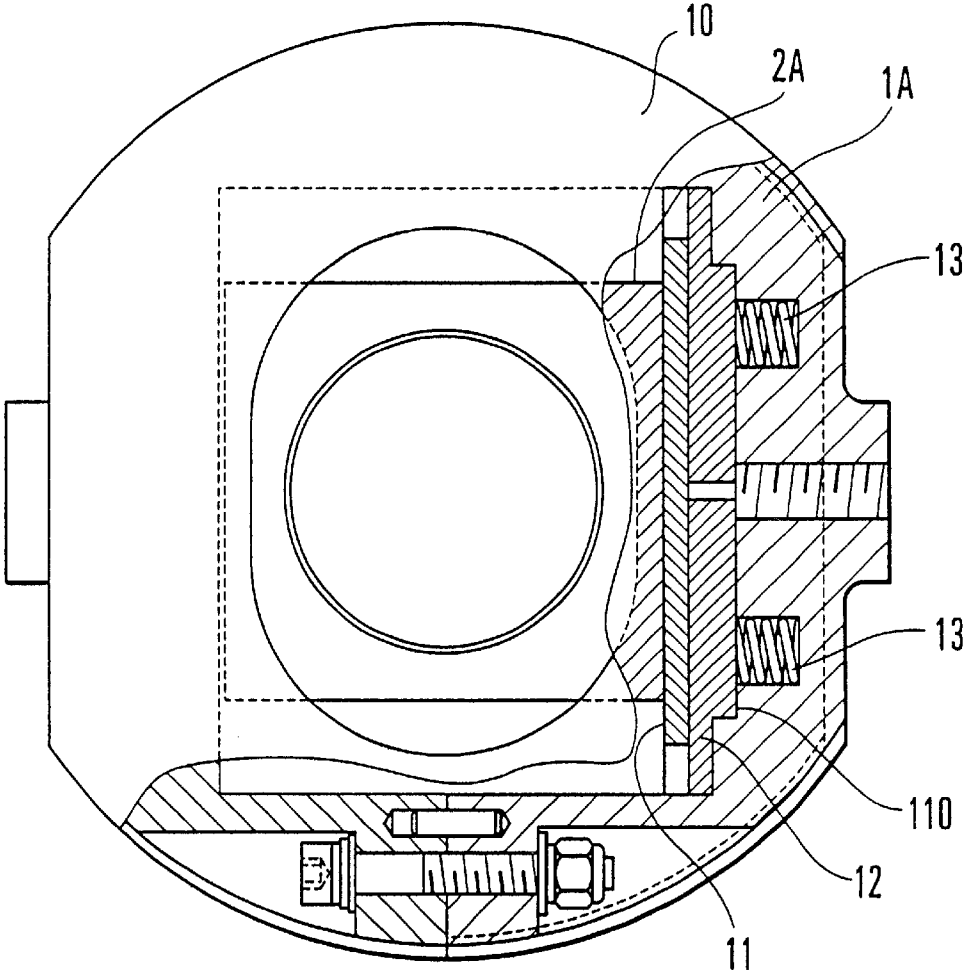
FIG. 16 is a partially cross-sectional view showing a slide mechanism portion of a cross slider in a multistage high pressure compressor according to the present invention.
Figure 18:
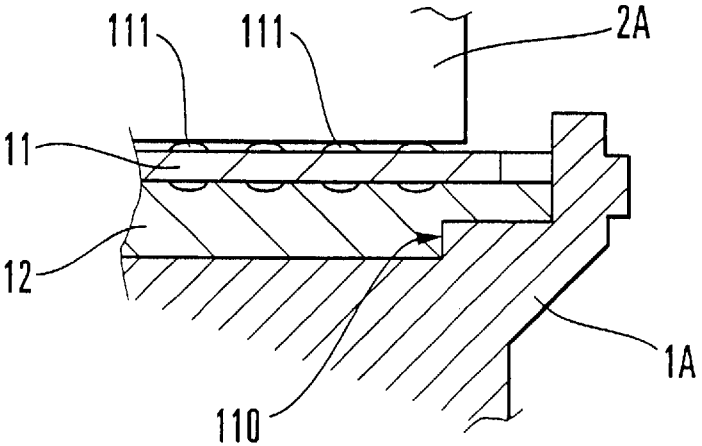
FIG. 18 is a partially cross-sectional view showing the slide mechanism portion of the cross slider in the multistage high pressure compressor according to the present invention.
Figure 17:
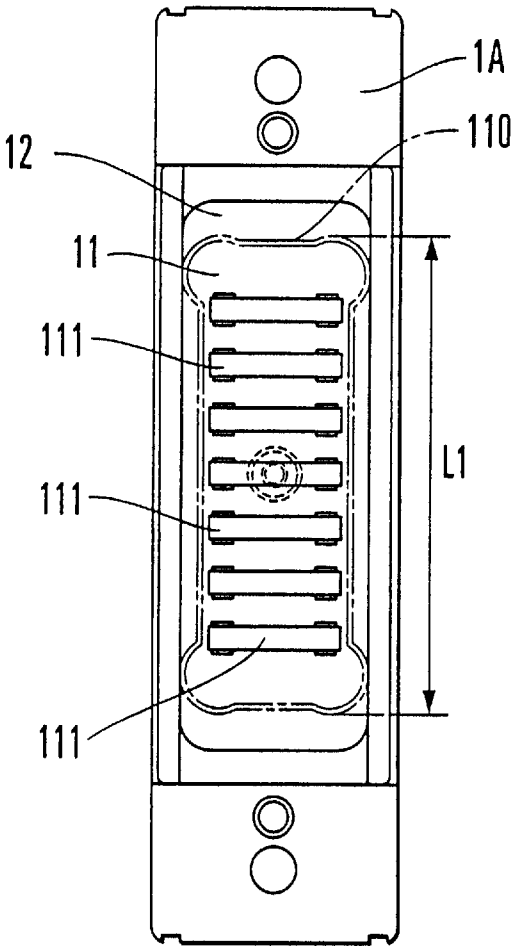
FIG. 17 is a side view of the slide mechanism portion of the cross slider in the multistage high pressure compressor according to the present invention as viewed from the side of a rolling bearing.

FIG. 16 to FIG. 18 show an example of the structure of the slide mechanism portion of the cross slider 2A in the multistage high pressure compressor 100 according to the present invention. Herein, the dimension (denoted by a length L1) of the receptacle (shoe) 110 for the liner plate 12 which is formed in the yoke 1A is identical to that of the receptacle (shoe) 110 of the prior art shown in FIG. 15. The liner plate 12 is a plate with a step-shaped configuration whose middle portion to be set in the receptacle (shoe) 110 has an uniform thickness and portions interposing the middle portion have a smaller thickness. The rolling bearing 11 having the plurality of rollers 111 arranged in the length direction is disposed on the surface of the liner plate 12. A load from the rollers 111 is received by the thick middle portion of the liner plate 12. Springs 13 are pressed against the thick middle portion of the liner plate 12. While the roller 111 in the prior art has a diameter of 2.5 mm, the above-described structure of the present invention makes it possible to employ a roller whose diameter is as long as 3 mm.

While the compression of the fourth stage compression section 104 is about 20 MPa(G) in the structure of the prior art, the compression of the fourth stage compression section 104 can be increased to about 30 MPa(G) due to the structure of the slide mechanism portion of the cross slider according to the present invention. This is because a planar pressure applied from the cross slider 2A can be reduced.

The above-described structure can be also applied to the cross slider 2B within the scope of the aforementioned technical concept.

Figure 19:
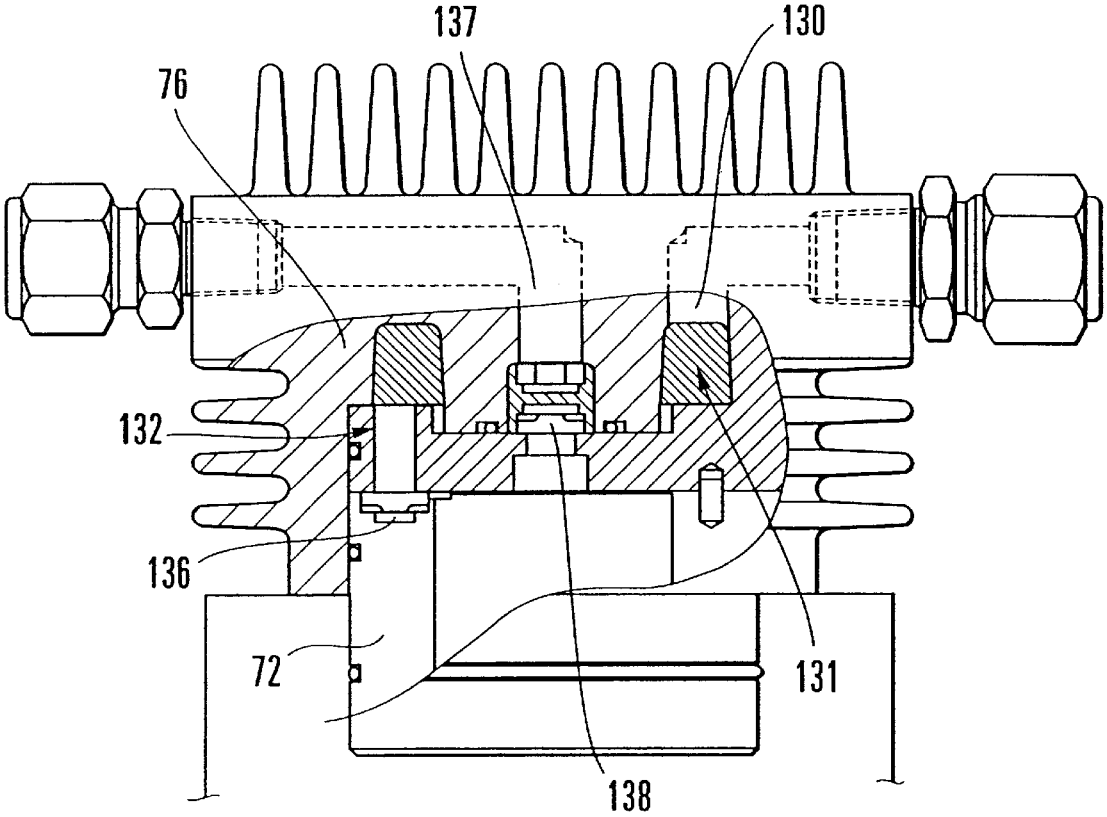
FIG. 19 is a cross-sectional view of a second stage compression section of a multistage high pressure compressor according to the present invention.
Figure 20:
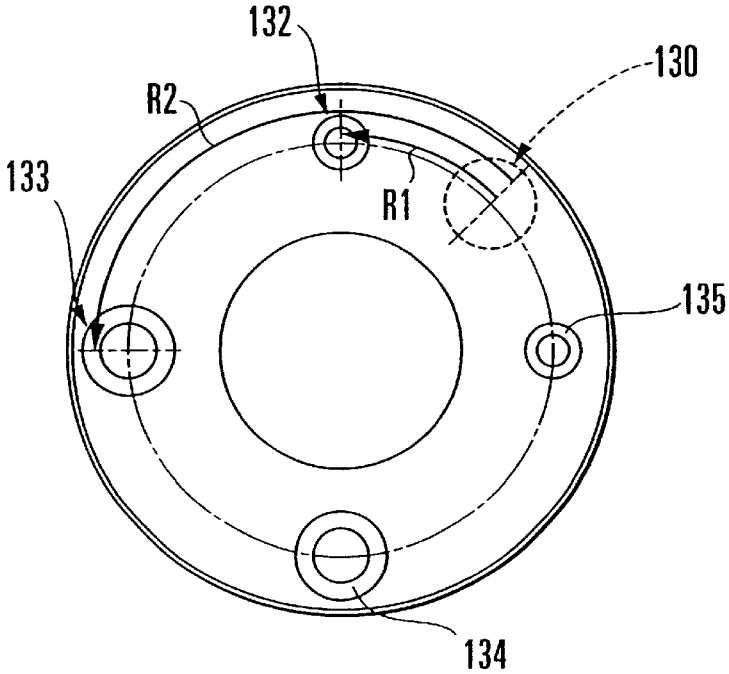
FIG. 20 is a diagram showing the arrangement of a cylinder port of the second stage compression section in the multistage high pressure compressor according to the present invention.

FIG. 19 and FIG. 20 show the structure for improving an intake efficiency of an intake gas for the multistage high pressure compressor 100 and for reducing the pulsation of the intake gas. Each of these figures concerns the second stage compression section 102. An intake gas from an intake port 130 for the second stage compression section 102 flows through a passage 131, four cylinder ports 132, 133, 134, and 135 which are intake ports for the cylinder 72, and intake valves respectively corresponding to the four cylinder ports (reference numeral 136 denotes the intake valve corresponding to the cylinder port 132), and the intake gas is then took into the cylinder 72. Reference numeral 137 denotes a discharge port for discharging a compressed gas from the cylinder 72 through a discharge valve 138. As shown in FIG. 20, the intake gas from the intake port 130 is divided into two flows from the intake port 130, which are directed respectively to the side of the cylinder port 132 and the side of the cylinder port 135.

The ratio of a distance R1 from the center of the intake port 130 to the center of the first cylinder port 132 and a distance R2 from the center of the intake port 130 to the second cylinder port 133 is equal to the ratio of a cross-sectional area W1 of the first cylinder port 132 and a cross-sectional area W2 of the second cylinder port 133, i.e., R2/R1=W2/W1. Similarly, the ratio of a distance R4 from the center of the intake port 130 to the center of the fourth cylinder port 135 and a distance R3 from the center of the intake port 130 to the third cylinder port 134 is equal to the ratio of a cross-sectional area W4 of the fourth cylinder port 135 and a cross-sectional area W3 of the third cylinder port 134, i.e., R3/R4=W3/W4.

Accordingly, when the passage resistance of the gas took into the cylinder 72 from the intake port 130 is substantially uniform (uniform or generally uniform), the intake efficiency can be improved, and the pulsation of the intake gas can be reduced.

Although the above-described structure is applied to the second stage compression section 102, the present invention is not limited thereto. The compression section of a different stage can employ the above-described structure within the scope of the aforementioned technical concept.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A multistage high pressure compressor, comprising:

an electric motor comprising a rotor with a rotating shaft and a stator, the electric motor being provided in a lower part of the multistage high pressure compressor; and a compression mechanism section comprising a cylinder and a piston, the compression mechanism section being provided in an upper part of the multistage high pressure compressor, wherein the compression mechanism section compresses an intake working fluid through a plurality of compression stages by reciprocateing the piston with respect to the cylinder by a rotation of the rotating shaft extending upwardly from the electric motor so that a high pressure working fluid is generated; and a fly wheel is attached to a lower end of the rotating shaft of the electric motor, and supports the rotor of the electric motor with respect to the rotating shaft.

2. The multistage high pressure compressor according to claim 1, wherein the lower end of the rotating shaft of the electric motor and the fly wheel to be attached thereto are joined by a bolt.

3. The multistage high pressure compressor according to claim 2, wherein a detent key for stopping a rotation is provided between the rotating shaft of the electric motor and the rotor of the electric motor, and an extension of the detent key is inserted into the fly wheel.

4. The multistage high pressure compressor according to claim 1, wherein the lower end of the rotating shaft of the electric motor and the fly wheel to be attached thereto are thread-coupled by screws mating with each other, which are formed in the lower end of the rotating shaft of the electric motor and the fly wheel.

5. The multistage high pressure compressor according to claim 1, wherein the lower end of the rotating shaft of the electric motor and the fly wheel to be attached thereto are joined by shrink-fitting therebetween.

6. A sealing device for a multistage high pressure compressor, the multistage high pressure compressor comprising:

an electric motor comprising a rotor with a rotating shaft and a stator; and a compression mechanism section comprising a cylinder and a piston and at least one member radially surrounding the cylinder, the cylinder having opposed ends and an outer peripheral cylindrical surface, wherein the compression mechanism section compresses an intake working fluid through a plurality of compression stages by reciprocating the piston with respect to the cylinder by a rotation of the rotating shaft extending upwardly from the electric motor so that a high pressure working fluid is generated; and a seal space formed in the cylinder at each juncture between the outer peripheral surface and the opposed ends of the cylinder for receiving a seal ring which is placed in the seal space and compressed between the cylinder and the at least one member surrounding thereof, whereby the cylinder is sealed.

* * * * *

UNITED STATES PATENT AND TRADEMARK OFFICE

CERTIFICATE OF CORRECTION

PATENT NO. : 6,431,840 B1
DATED : August 13, 2002
INVENTOR(S) : Denji Mashimo et al.

It is certified that error appears in the above-identified patent and that said Letters Patent is hereby corrected as shown below:

Column 1,
Line 51, “numeral is” should read -- numeral 35 is --; and

Column 4,
Line 14, “a-” should read -- a --.

Signed and Sealed this

Twenty-second Day of April, 2003

JAMES E. ROGAN
*Director of the United States Patent and Trademark Office*